US011021975B2

(12) United States Patent
Mailloux-Labrousse et al.

(10) Patent No.: US 11,021,975 B2
(45) Date of Patent: Jun. 1, 2021

(54) GAS TURBINE ENGINE AND ROTARY ASSEMBLY THEREFOR

(71) Applicant: PRATT & WHITNEY CANADA CORP., Longueuil (CA)

(72) Inventors: Marc-Antoine Mailloux-Labrousse, Montreal (CA); Othmane Leghzaouni, Brossard (CA); Yves Roussel, Varennes (CA); Max Bergeron-Fillion, St-Hubert (CA)

(73) Assignee: PRATT & WHITNEY CANADA CORP, Longueuil (CA)

( * ) Notice: Subject to any disclaimer, the term of this patent is extended or adjusted under 35 U.S.C. 154(b) by 122 days.

(21) Appl. No.: 16/273,653

(22) Filed: Feb. 12, 2019

(65) Prior Publication Data

US 2020/0256203 A1 Aug. 13, 2020

(51) Int. Cl.
*F01D 5/30* (2006.01)
*F01D 25/28* (2006.01)

(52) U.S. Cl.
CPC ..... *F01D 5/3023* (2013.01); *F01D 25/285* (2013.01); *F05D 2220/32* (2013.01); *F05D 2230/60* (2013.01); *F05D 2240/24* (2013.01); *F05D 2260/12* (2013.01); *F05D 2260/36* (2013.01); *F05D 2260/83* (2013.01)

(58) Field of Classification Search
CPC ..... F05D 2230/60; F05D 2260/12; F05D 2260/36; F05D 2260/37; F05D 2260/83; F05D 2240/24; F05D 2300/5021; F05D 2300/50212; F01D 5/025; F01D 5/026; F01D 5/06; F01D 5/066; F01D 25/285; F04D 29/0405; F04D 29/044; F04D 29/054; F16D 1/06; F16D 1/064; F16D 3/10; F05B 2280/5003; F05B 2280/50032; Y10T 403/70; Y10T 403/7073
USPC ..... 403/345, 375; 464/1
See application file for complete search history.

(56) References Cited

U.S. PATENT DOCUMENTS

| | | | | |
|---|---|---|---|---|
| 5,622,475 | A | 4/1997 | Hayner et al. | |
| 2014/0369840 | A1* | 12/2014 | Pinkney | F01D 5/025 416/204 A |
| 2015/0369061 | A1 | 12/2015 | Sandoval et al. | |
| 2017/0184118 | A1* | 6/2017 | Lueddecke | F04D 29/644 |

* cited by examiner

*Primary Examiner* — Igor Kershteyn
*Assistant Examiner* — Elton K Wong
(74) *Attorney, Agent, or Firm* — Norton Rose Fulbright Canada LLP

(57) ABSTRACT

The gas turbine engine can have a first and second rotary components structurally joined to one another via a connector, a first spigot fit between the connector and the first rotary component, the first spigot fit forming an interference fit at a first operating condition and forming a gap at a second operating condition, a second spigot fit between the connector and the first rotary component, the second spigot fit forming an interference fit at the second operating condition and forming a gap at the first operating condition, the gas turbine engine being further configured to form a radial interference fit between the connector and the second rotary component in both the first and second operating conditions.

13 Claims, 5 Drawing Sheets

GAS TURBINE ENGINE AND ROTARY ASSEMBLY THEREFOR

TECHNICAL FIELD

The application related generally to gas turbine engines and, more particularly, to a structure having a connector joining two rotary components to one another.

BACKGROUND OF THE ART

It was known to structurally join rotary components to one another using a spigot fit, i.e. an arrangement where a male portion of a first one of the rotary components was press-fitted into a female portion of a second one of the rotary components, with an annular, radial interference fit being formed therebetween. Over the use of fasteners, for instance, such an arrangement can provide the benefit of greater simplicity. However, such arrangements were not suitable for all conditions. Indeed, there is a limit to the amount of interference which can be achieved upon press fitting, and in some conditions of use, the deformation between the rotary components in conditions of use can be unequal, and the growing of the first rotary component relative to the second rotary component can lead to progressively diminishing interference of the fit therebetween, and ultimately to the formation of a gap and to the loss of the structural joint. There thus remained room for improvement.

SUMMARY

In one aspect, there is provided a rotary assembly comprising a first and second rotary components structurally joined to one another via a connector, a first radial fit between the connector and the first rotary component, the first radial fit forming an interference fit at a first operating condition of the rotary assembly and forming a gap at a second operating condition, a second radial fit between the connector and the first rotary component, the second radial fit forming an interference fit at the second operating condition and forming a gap at the first operating condition, the rotary assembly being further configured to form a radial interference fit between the connector and the second rotary component in both the first and the second operating conditions.

In another aspect, there is provided a gas turbine engine comprising a first and second rotary components structurally joined to one another via a connector, a first radial fit between the connector and the first rotary component, the first radial fit forming an interference fit at a first operating condition and forming a gap at a second operating condition, a second radial fit between the connector and the first rotary component, the second radial fit forming an interference fit at the second operating condition and forming a gap at the first operating condition, the gas turbine engine being further configured to form a radial interference fit between the connector and the second rotary component in both the first and second operating conditions.

In a further aspect, there is provided a method of operating a gas turbine engine having a first radial fit between a connector and a first rotary component and a second radial fit between a connector and the first rotary component, the connector structurally joining the first rotary component to a second rotary component, the method comprising: in a first operating condition, providing an interference fit at the first radial fit, and a loose fit at the second radial fit; transitioning from the first operating condition to a second operating condition, including gradually reducing the interference fit of the first radial fit, the first radial fit forming a gap at the second operating condition, and gradually reducing the gap of the loose fit, the second radial fit forming an interference fit at the second operating condition; maintaining at least one radially-oriented interference fit between the second rotary component and the connector throughout the transitioning.

DESCRIPTION OF THE DRAWINGS

Reference is now made to the accompanying figures in which.

DETAILED DESCRIPTION

Figure 1:
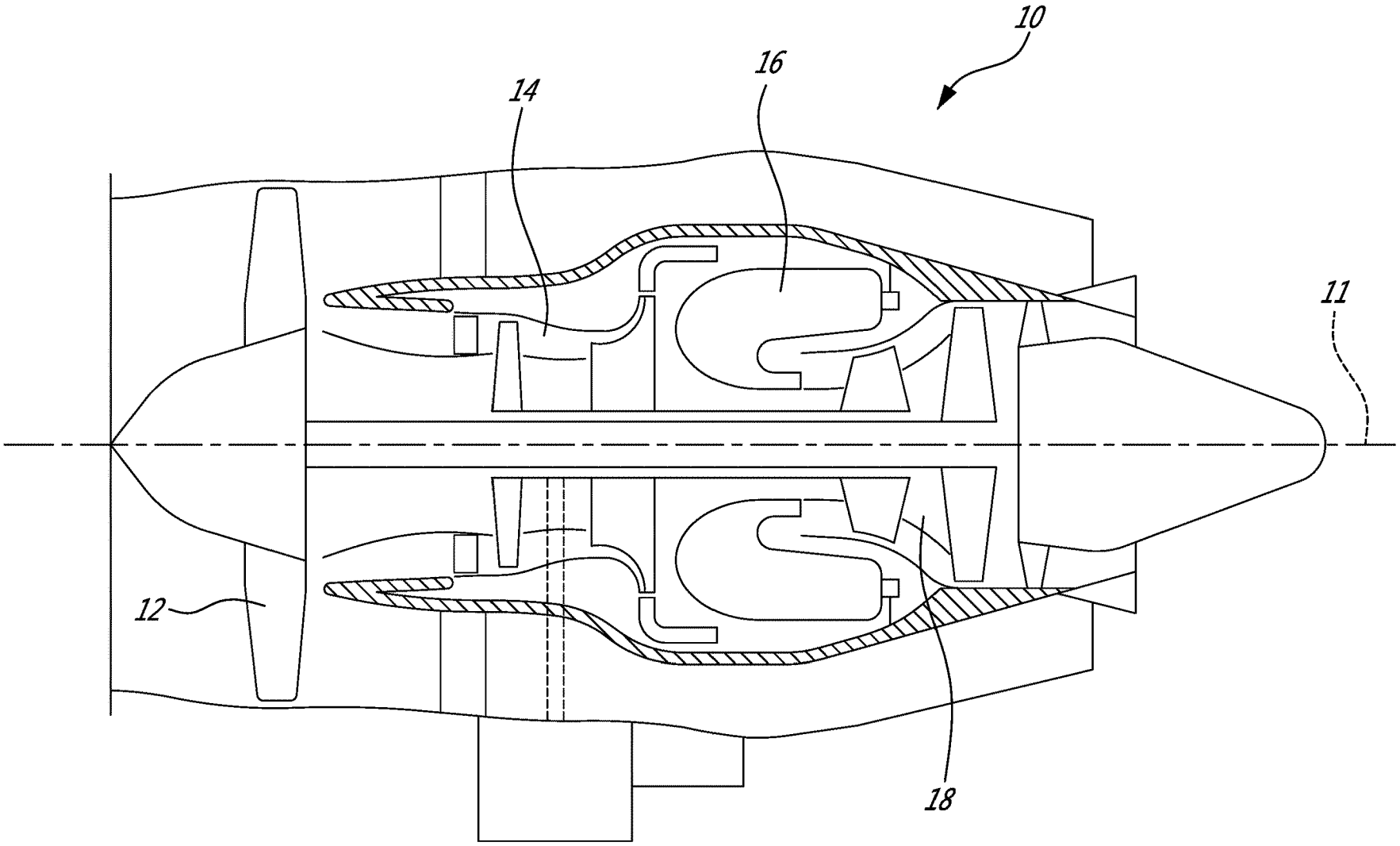
FIG. 1 is a schematic cross-sectional view of a gas turbine engine.

FIG. 1 illustrated a gas turbine engine 10 of a type preferably provided for use in subsonic flight, generally comprising in serial flow communication a fan 12 through which ambient air is propelled, a compressor section 14 for pressurizing the air, a combustor 16 in which the compressed air is mixed with fuel and ignited for generating an annular stream of hot combustion gases, and a turbine section 18 for extracting energy from the combustion gases.

The compressor section 14 can include, for instance, a plurality of rotors and stators. The rotors can be formed of separately manufactured rotor discs and blades which are assembled to form the rotor, such as via a dovetail engagement for instance, or be provided in the form of integrally bladed rotors, to name two relatively common examples.

Integrally bladed rotors, in particular, are subjected to a significant amount of design testing, which can be performed using a device referred to as a test rig, such as a cold flow test rig for instance. In such a test environment, it can be desired to test a rotary assembly including two adjacent rotors at different inter-rotor spacings. In this context, it can be useful to provide a plurality of connectors designed to be assemblable to the two adjacent rotors in a manner to structurally join the two adjacents rotors to one another for a given test, during which the test rig rotates the rotary structure with a first inter-rotor spacing. Following a given test, the connector can then be removed, and replaced with a connector having a different axial thickness, to test the same rotors again, but with a different inter-rotor spacing.

Figure 2B:
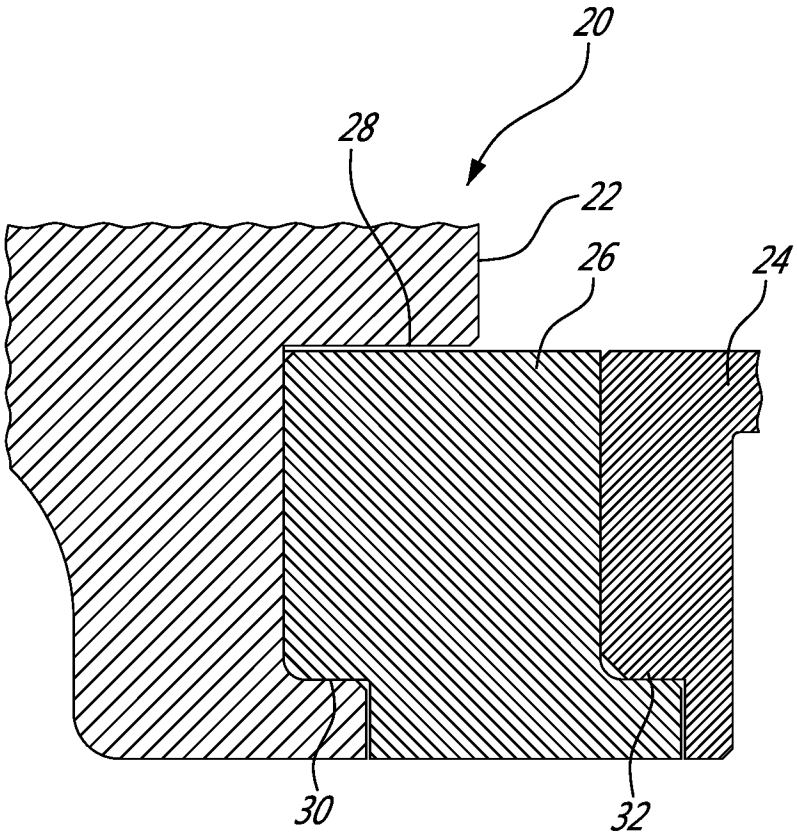
FIGS. 2A and 2B are cross-sectional views show a portion of a first embodiment of a rotary assembly, with FIG. 2A in a first operating condition, and FIG. 2B in a second operating condition.
Figure 2A:
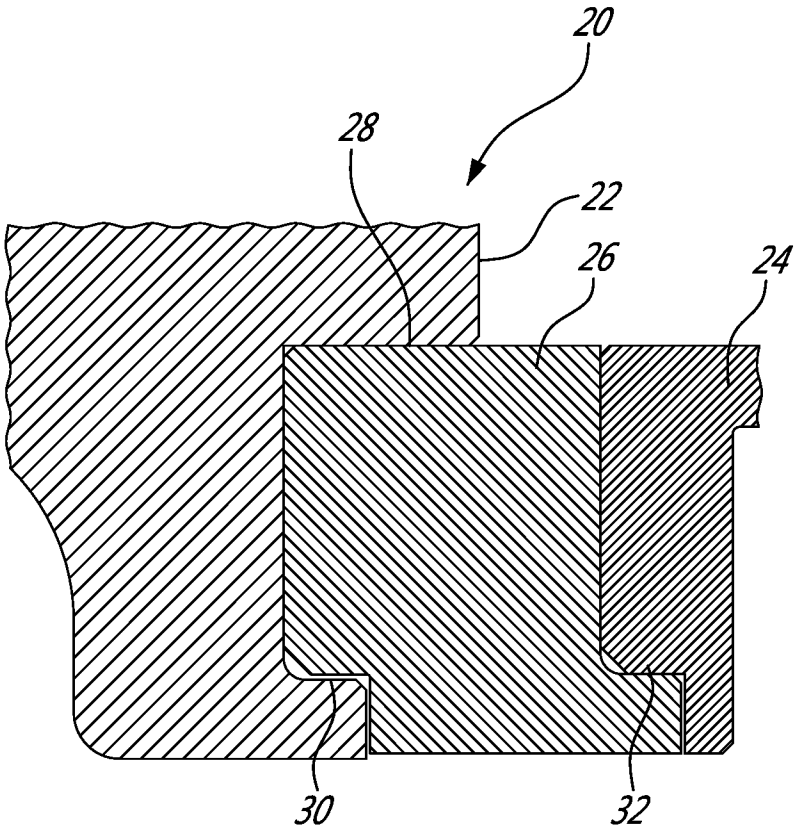

FIGS. 2A and 2B show an example of a rotary structure 20 which has two rotary components 22, 24 structurally joined to one another via a connector 26. The connector 26 has a first radial fit 28 with the first rotary component 22, and a second radial fit 30 with the second rotary component 24. As will be explained below, the first radial fit 28 forms an interference fit in a first operating condition shown in FIG. 2A, during which the second radial fit 30 forms a gap/loose fit, and vice-versa in the second operating condition shown in FIG. 2B, maintaining an interference fit between the connector 26 and the first radial component 22 in both operating conditions. It will be noted that an interference fit is also maintained between the connector 26 and the second rotary component 24 in both operating conditions, effectively structurally joining the two rotary components 22, 24 in these two operating conditions. In the radial fits, the faces which engage one another extend axially and are pressed against one another in the radial orientation (relative to the engine axis 11). The faces typically extend annularly, around an entire circumference (cylindrically), and the resulting interference fit can be referred to as a spigot fit. In this example, the two rotary components 22, 24 are corresponding integrally bladed rotors configured for testing in a test rig. It will be understood that the two rotary components 22, 24 can be other components in alternate embodiments.

FIG. 2A shows the rotary structure 20 in a first operating condition. The first operating condition, in this example, is the rest condition. The first radial fit 28, which is an interference fit in this operating condition, can be formed by press-fitting an outer diameter face of the connector 26 into an inner diameter face of the first rotary component 22, for instance. In this first operating condition, the second radial fit 30, which can be formed between a radially inner diameter face of the connector 26 and a radially outer diameter face of the first rotary component 22 can be loose, and have a small gap between the two components. In this embodiment, the second operating condition can correspond to a condition in which the rotary assembly is rotated at a relatively high RPM, which can impart stress to the components due to centripetal acceleration, resulting in growth of the components. This stress can be greater in components which are heavier than in components which are lighter, and in components which have a more radially-outwardly distributed mass. In the case of an integrally bladed rotor, for instance, the integrally bladed rotor can have a significantly greater weight and have a mass which is significantly more radially-outwardly distributed than the connector 26, for instance. In such a scenario, even if the connector 26 is made of a material having the same elasticity than the rotor, such as the same metal for instance, the rotor will nonetheless be subjected to greater growth than the connector 26.

A similar effect can occur if the first rotary component 22 and the connector 26 have a different thermal growth coefficient and the second operating condition is at a higher temperature than the first operating condition, for instance, or simply if they have a different level of elasticity (e.g. Young's modulus). In the transition to the second operating condition, the growth of the first rotary component 22 leads to progressively lesser interference in the first radial fit 28. However, simultaneously, it also leads to a progressively lesser gap in the second radial fit 30, and eventually to progressively increasing interference fit in the second radial fit 30. At the second operating condition, the interference fit of the first radial fit 28 can be completely lost, and replaced with a gap, but the structural joint between the connector 26 and the first rotary component 26 can nonetheless be maintained via the second radial fit 30.

It will be noted here that the radial direction, or relative orientation, of the first rotary component 22 and of the connector 26 is inversed from the first radial fit 28 to the second radial fit 30, and that the initial gap of the second radial fit 30 is designed to be sufficiently small to allow it to become an interference fit in the second operating condition. Moreover, throughout the transition, a third radial fit 32 is maintained in an interference fit condition, between a radially-outwardly facing cylindrical face of the connector 26 and a radially-inwardly facing cylindrical face of the second rotary component 24. In this embodiment, this was achieved while avoiding to subject the connector 26, or any of the two rotary components 22, 24, to critical deformation stresses which could have led to a failure, such as a crack formation.

The design of the fit was achieved using ANSYS software, a finite element type analysis software, which can allow to simulate the conditions, and resulting stresses, using a computer and virtual models of the components of the rotary assembly. It will be noted that the initial interference fit conditions themselves, at the first radial fit and the third radial fit, impart stresses, and thus deformation into the components, including the connector, which must be taken into account in designing such a structural joint. However, simulations performed using the ANSYS software led to the conclusion that using such a three radial fit solution to join two rotary components using a connector, could lead to a workable solution, and such a workable solution may be of use in a test rig or in a gas turbine engine environment, for instance. Though the calculations are more complex than modeling single radial fits, the ANSYS software was nonetheless able to perform them.

Figure 3:
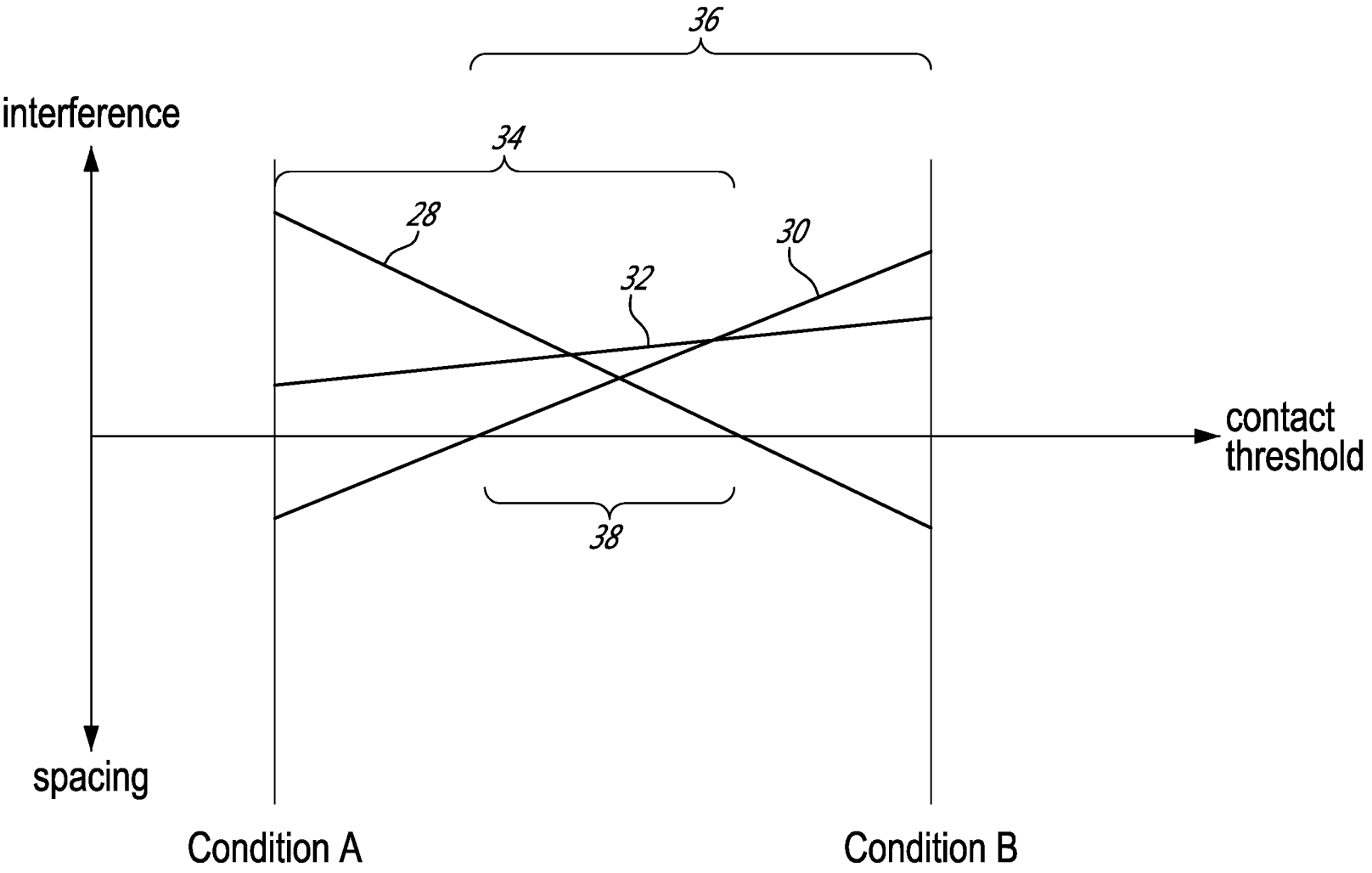
FIG. 3 is a graph schematically illustrating the transition between the first operating condition and the second operating condition.

The varying conditions during the transition are schematized in the graph shown in FIG. 3. The progressive reduction of the interference in the first radial fit 28 is shown by a line which begins with a significant interference fit in condition A, and which progresses to a gap/spacing at condition B. The portion of the graph where the interference fit of the first radial fit 28 is maintained can be referred to as the first radial fit interference zone 34. Similarly, the second radial fit 30 is shown to have a negative value at condition A which progresses until reaching zero, and then an increasing positive value along a second radial fit interference zone 36. It will be noted that in this embodiment, there is a zone 38 in the graph where both the first and the second radial fits 28, 30 are in an interference fit scenario, which can be referred to as a zone of overlapping interference 38. Such a zone 38 can be useful in ensuring that a structural joint is maintained throughout the transition. It will also be noted that in this embodiment, the third interference fit 32 is maintained in the positive values of interference throughout the transition.

Figure 4:
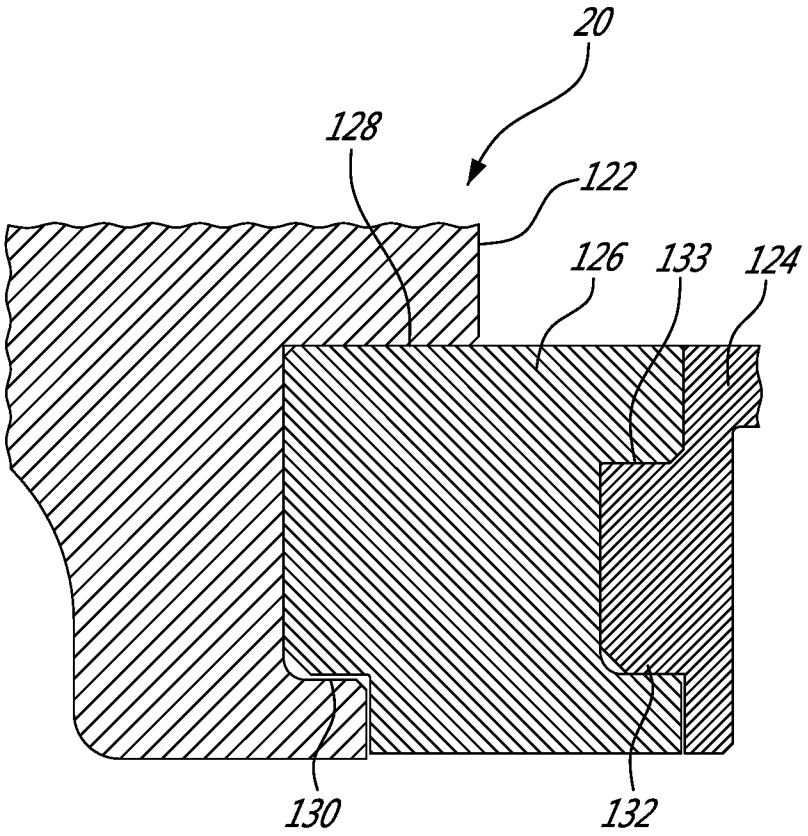
FIG. 4 is a cross-sectional view similar to FIG. 2A, showing a second embodiment.
Figure 5:
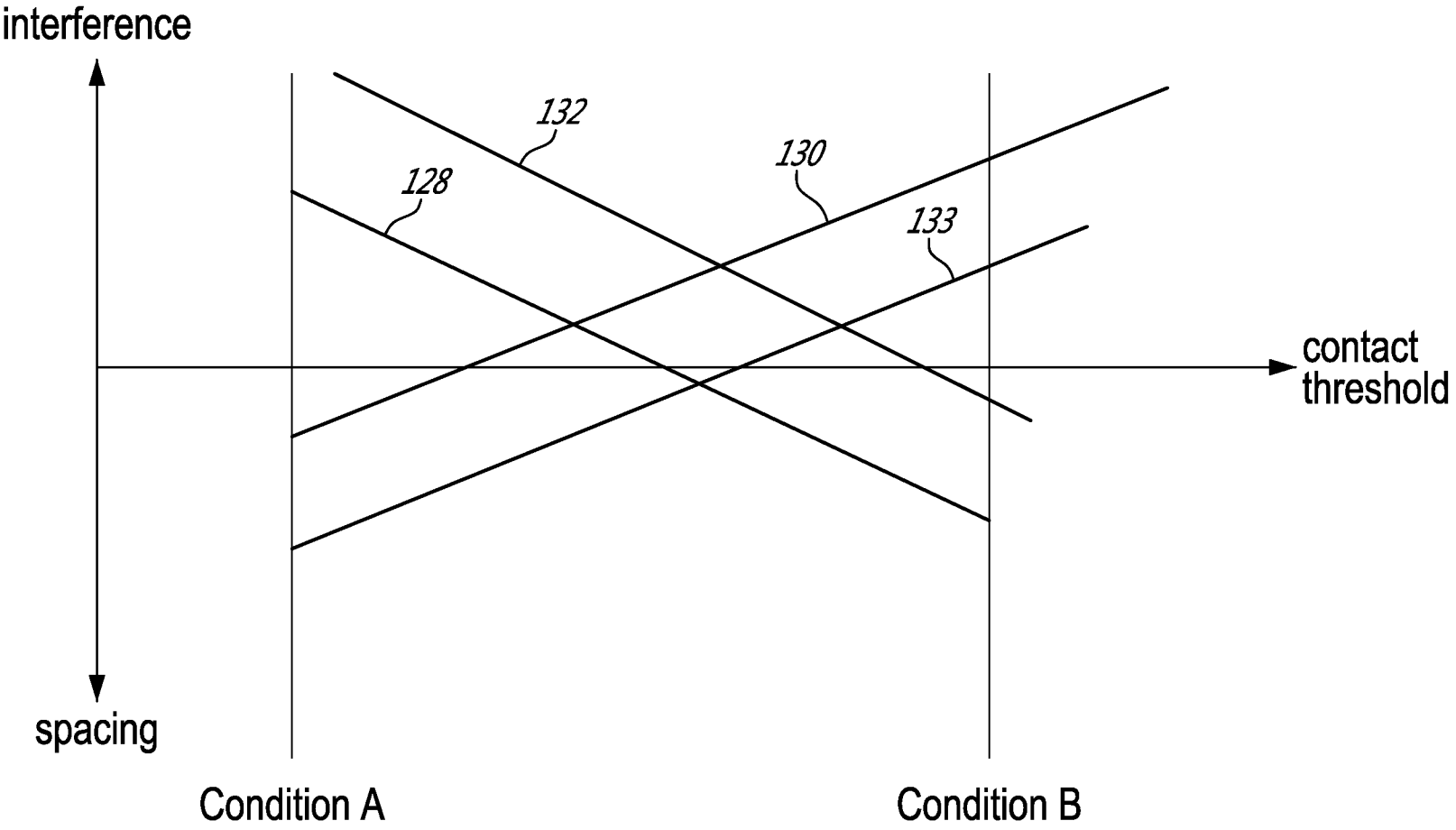
FIG. 5 is a graph schematically illustrating the transition between the first operating condition and the second operating condition for the embodiment of FIG. 4.

FIG. 4 shows an other embodiment. In this other embodiment, a double radial fit engagement is used not only between the connector 126 and the first rotary component 122, but also between the connector 126 and the second rotary component 124. More specifically, the double radial fit (128, 130) between the connector 126 and the first rotary component 122 is as illustrated in FIG. 2A, but rather than using a single radial fit between the connector 126 and the second rotary component 124, a third 132 and a fourth 133 radial fits are used. The third radial fit 132, in this embodiment, can be similar to the third radial fit of the embodiment of FIG. 2A. However, in this embodiment, it was not found suitable to provide a third radial fit having an interference level sufficient to be maintained at the second operating condition, where a gap was instead present. In this embodiment, this was compensated by providing a fourth radial fit 133, having again an inversed radial direction compared with the other radial fit 132, which begins with a gap, but eventually reaches engagement, and ultimately a suitable level of interference to maintain an interference fit between the connector 126 and the second rotary component 124 throughout the transition, similarly to what was achieved in FIG. 2A-2B using a single radial fit 32 between the connector 26 and the second rotary component 24.

In a gas turbine engine environment, the first condition can be an engine idle condition, for instance, and the second condition can be a full thrust condition, for instance.

The above description is meant to be exemplary only, and one skilled in the art will recognize that changes may be made to the embodiments described without departing from the scope of the invention disclosed. For example, the radial fits can be positioned in different configurations than those illustrated in the examples, and can be axially spaced apart from one another, for instance. In some embodiments, each radial fit can include more than one set of engaging cylindrical surfaces. Moreover, and if different growth phenomena are present for instance, it can be preferable to use more than two radial fits between the connector and any one of the two rotary components, such as a second one which becomes engaged due to thermal growth and a third one which becomes engaged due to centripetal acceleration, for instance. If applied in a gas turbine engine context, the connector and dual radial fit-based structural joining concept presented above can be applied between various gas turbine engine components, such as between a coverplate and a disc, between two discs, between a disc and an impeller, between attachments, etc. Still other modifications which fall within the scope of the present invention will be apparent to those skilled in the art, in light of a review of this disclosure, and such modifications are intended to fall within the appended claims.

The invention claimed is:

1. A rotary assembly comprising a first rotary component and a second rotary component structurally joined to one another via a connector, a first spigot fit between the connector and the first rotary component, the first spigot fit forming an interference fit at a first operating condition of the rotary assembly and forming a gap at a second operating condition, a second spigot fit between the connector and the first rotary component, the second spigot fit forming an interference fit at the second operating condition and forming a gap at the first operating condition, the rotary assembly being further configured to form an interference fit between the connector and the second rotary component in both the first and the second operating conditions.

2. The rotary assembly of claim 1 wherein the second operating condition has a greater revolution per minute (RPM) than the first operating condition, the first rotary component being stretched radially outwardly by centripetal acceleration compared to the first operating condition, more than the connector is stretched radially outwardly by the centripetal acceleration.

3. The rotary assembly of claim 1 wherein the first spigot fit is a spigot fit of the connector into the first rotary component.

4. The rotary assembly of claim 3 wherein the second spigot fit is a spigot fit of the first rotary component into the connector.

5. The rotary assembly of claim 3 further comprising a spigot fit of the connector into the second rotary component, forming an interference fit in both the first operating condition and the second operating condition.

6. A gas turbine engine comprising a first rotary component and a second rotary component structurally joined to one another via a connector, a first radial fit between the connector and the first rotary component, the first radial fit forming an interference fit at a first operating condition and forming a gap at a second operating condition, a second radial fit between the connector and the first rotary component, the second radial fit forming an interference fit at the second operating condition and forming a gap at the first operating condition, the gas turbine engine being further configured to form a radial interference fit between the connector and the second rotary component in both the first and second operating conditions.

7. The gas turbine engine of claim 6 wherein the second operating condition has a greater revolution per minute (RPM) than the operating condition, the first rotary component being heavier and being more radially-outwardly distributed than the connector and thereby being stretched radially outwardly by centripetal acceleration compared to the first operating condition, more than the connector is stretched radially outwardly by the centripetal acceleration.

8. The gas turbine engine of claim 6 wherein the first radial fit is a spigot fit of the connector into the first rotary component.

9. The gas turbine engine of claim 8 wherein the second radial fit is a spigot fit of the first rotary component into the connector.

10. The gas turbine engine of claim 8 further comprising a spigot fit of the connector into the second rotary component.

11. The gas turbine engine of claim 6 wherein the first rotary component is a first integrally bladed rotor and the second rotary component is a second integrally bladed rotor.

12. A method of operating a gas turbine engine having a first radial fit between a connector and a first rotary component and a second radial fit between the connector and the first rotary component, the connector structurally joining the first rotary component to a second rotary component, the method comprising:

in a first operating condition, providing an interference fit at the first radial fit, and a loose fit at the second radial fit;

transitioning from the first operating condition to a second operating condition, including gradually reducing the interference fit of the first radial fit, the first radial fit forming a gap at the second operating condition, and gradually reducing the gap of the loose fit, the second radial fit forming an interference fit at the second operating condition;

maintaining at least one radially-oriented interference fit between the second rotary component and the connector throughout the transitioning.

13. The method of claim 12 wherein said transitioning includes maintaining an interference fit of both the first radial fit and the second radial fit within a given period of said transitioning.

* * * * *